US007819510B2

(12) United States Patent
Padgett et al.

(10) Patent No.: US 7,819,510 B2
(45) Date of Patent: Oct. 26, 2010

(54) INKJET FINGER MANIFOLD

(75) Inventors: James Dudley Padgett, Lake Oswego, OR (US); Garry Adam Jones, Sherwood, OR (US)

(73) Assignee: Xerox Corporation, Norwalk, CT (US)

( * ) Notice: Subject to any disclaimer, the term of this patent is extended or adjusted under 35 U.S.C. 154(b) by 584 days.

(21) Appl. No.: 11/291,288

(22) Filed: Nov. 30, 2005

(65) Prior Publication Data

US 2007/0120895 A1 May 31, 2007

(51) Int. Cl.
*B41J 2/175* (2006.01)

(52) U.S. Cl. ..... 347/85; 347/93

(58) Field of Classification Search ..... 347/35, 347/65, 92, 84–85, 54, 93
See application file for complete search history.

(56) References Cited

U.S. PATENT DOCUMENTS 4,883,219 A * 11/1989 Anderson et al. ..... 228/190
5,455,615 A * 10/1995 Burr et al. ..... 347/92
5,650,810 A * 7/1997 Muto ..... 347/71

* cited by examiner

*Primary Examiner*—An H Do
(74) *Attorney, Agent, or Firm*—Marger Johnson & McCollom, P.C.

(57) ABSTRACT

An inkjet finger manifold is provided that includes a longitudinal manifold chamber with an entrance at a first end adjacent to a first longitudinal side. A purge vent is located at a second end on a second longitudinal side opposite the first longitudinal side. A first ramp is located at the first end sloping away from the entrance toward the second longitudinal side. A second ramp is located near the second end and slopes from the second longitudinal side toward the second end and the first longitudinal side to alter the laminar flow of the ink through the longitudinal manifold.

13 Claims, 4 Drawing Sheets

INKJET FINGER MANIFOLD

BACKGROUND

The present disclosure relates to inkjet printing, and more particularly toward an inkjet printhead useful in ejecting non-water-based inks in an imagewise fashion.

A typical inkjet printer supplies ink to create a printed image through inkjets that are part of jet stacks. A jet stack is a stack of etched plates that are brazed together having etched cavities that are aligned to form numerous ink passageways and manifolds that feed ink to inkjet apertures etched on a face of the jet stack. To feed the numerous individual jets, a jet stack normally includes a main manifold that runs across a length of the jet stack (x-direction). Numerous smaller manifolds, called finger manifolds, feed a y-direction distribution of jets. The finger manifolds ensure that proper mass flow is maintained to the individual jets.

The word "printer" as used herein encompasses any apparatus, such as digital copier, bookmaking machine, facsimile machine, multi-function machine, etc. that performs a print outputting function for any purpose.

Some inkjet printers, such as those that use melted solid ink, must have their printheads purged after warming the supply of solid ink. A warming cycle melts both the ink supply in preparation for its use and melts any residual ink left in the printhead. Melted ink is then purged from the printhead by applying a flow of melted ink to the printhead. Purging the ink through all of the ink-jets ensures a proper mass flow is available to each ink-jet.

FIG. 1 is a wire frame perspective view of typical finger manifold 20. The longitudinal manifold 20 includes an entrance 22 at a first end 24, a filter 26 on a first side 28 and a purge vent 30 at a second end 32. The purge vent 30 is located on a second side 34 opposite the first side 28. Arrows 36 show a typical laminar flow of ink through the finger manifold 20 during a purge. The ink flows into the manifold 20 from the entrance 22 and then out past through the filter 26 to inlets 38 that lead to the inkjet apertures not shown in this drawing.

The filter 26 prevents contamination of the inkjets by filtering unwanted particulates from entering the inlets 38. The filter 26 is a perforated thin plate with holes smaller than the inlets 38.

Large scale bubbles that may enter the finger manifold 20 during purging cannot go through the filter 26 because the holes that are smaller than the bubble are so numerous that the flow will simply go around a bubble instead of dragging the bubble through the filter 26. Also, pressure cannot be increased enough to merely push the bubble through the filter 26 because components of the finger manifold 20 are so thin that they may be damaged by too much ink pressure.

The purge vent 30 does provide a significant enough pressure drop to allow a bubble to exit. The laminar flow 36 of ink entering the manifold 20 then pushes the bubble to the purge vent 30.

The finger manifold 20 may be oriented so that the first end 24 and entrance 22 becomes even vertically higher than the second end 32, as shown in the cross-section view of the finger manifold 20 in FIG. 2. Streamlines 36 show that ink entering near manifold 20 closer to the second side 34 vents out of the purge vent 30. The laminar flow 36, however, splits at location 40 which results in the flow 36 forcing a bubble 42 to remain trapped in the manifold 20 at the second end 32. This trapped bubble 42 may cause problems with acoustic resonance in the ink flow resulting in misfiring or non-firing of inkjets. Further the bubble may take hours to dissolve.

Also, with this tilted orientation, a bubble 44 remaining in the finger manifold 20 gets trapped in the corner 46 at the first end 24 due to the buoyancy of the bubble. As shown, the laminar flow 36 of the ink does not dislodge bubble 44 from this corner. Similarly, the bubble 44 may cause problems with ink flow resulting reduced performance of the printer.

SUMMARY OF THE DISCLOSURE

As described herein, an inkjet finger manifold has a longitudinal chamber with an entrance at a first end adjacent to a first longitudinal side. The manifold includes exit ports arranged along the first longitudinal side and a purge vent located at a second end on a second longitudinal side opposite the first longitudinal side. A first ramp at the first end slopes away from the entrance toward the second longitudinal side. A second ramp located near the second end slopes from the second longitudinal side toward the second end and toward the first longitudinal side to alter a flow to the purge vent.

The inkjet finger manifold is part of a printhead that can be manufactured using a method described herein. Cavities defining manifolds are etched into a plurality of plates. The plates are then stacked to form a printhead body thereby forming the manifolds by aligning the cavities. Cavities in successive plates are etched so that edges are offset from plate to plate to form ramps within the manifolds

DETAILED DESCRIPTION

In solid ink inkjet printers, solid ink is melted and fed to a printhead that transfers the melted ink imagewise onto an intermediate image drum. The image is then transferred from the drum to print media that is rolled against the drum. Within the printhead, different colored melted ink is supplied to inkjets on a face of the printhead through channels formed of aligned etched cavities in a stack of plates. To ensure proper mass flow to each inkjet, the printhead typically includes numerous small, or finger, manifolds that each feed ink to a number of inkjets.

Figure 1:
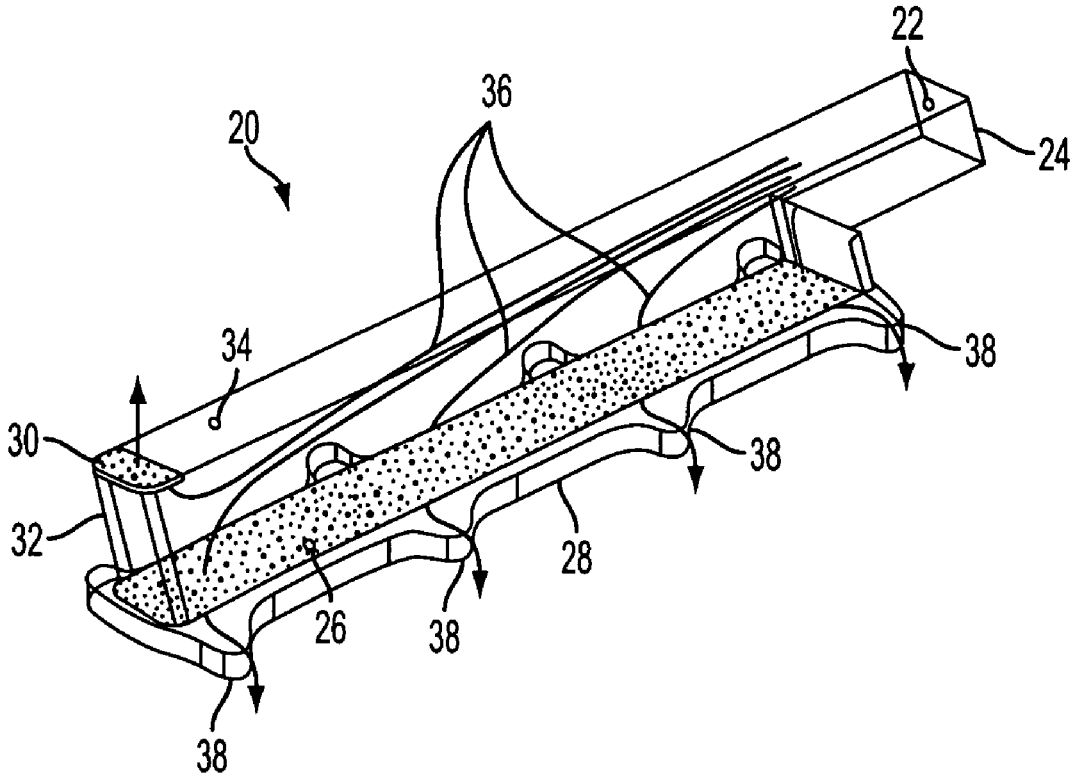
FIG. 1 (PRIOR ART)
FIG. 1 is a wire frame perspective view of a current inkjet finger manifold.
Figure 2:
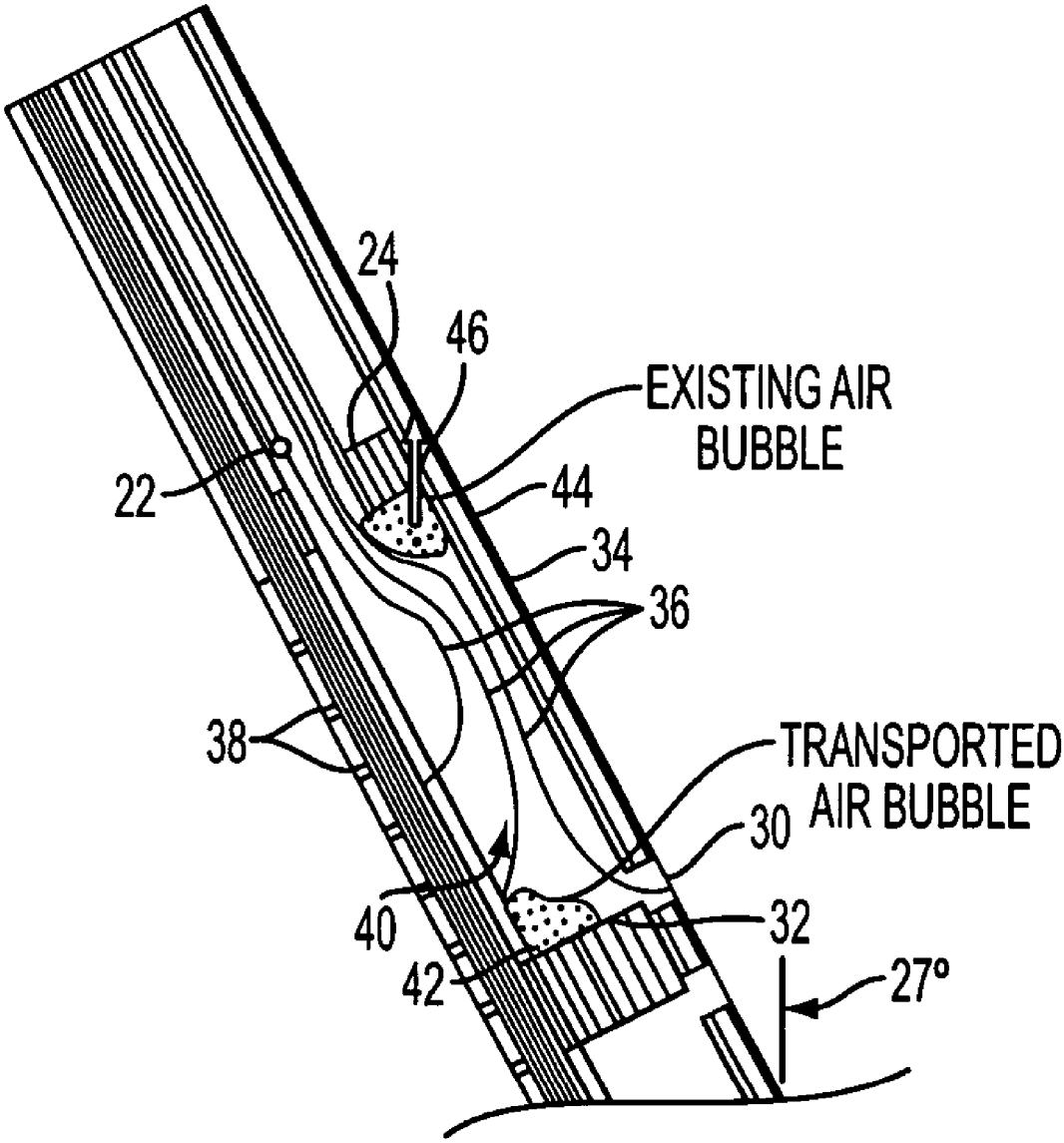
FIG. 2 (PRIOR ART)
FIG. 2 is a cross-section view of the current inkjet finger manifold in FIG. 1 showing trapped bubbles.
Figure 3:
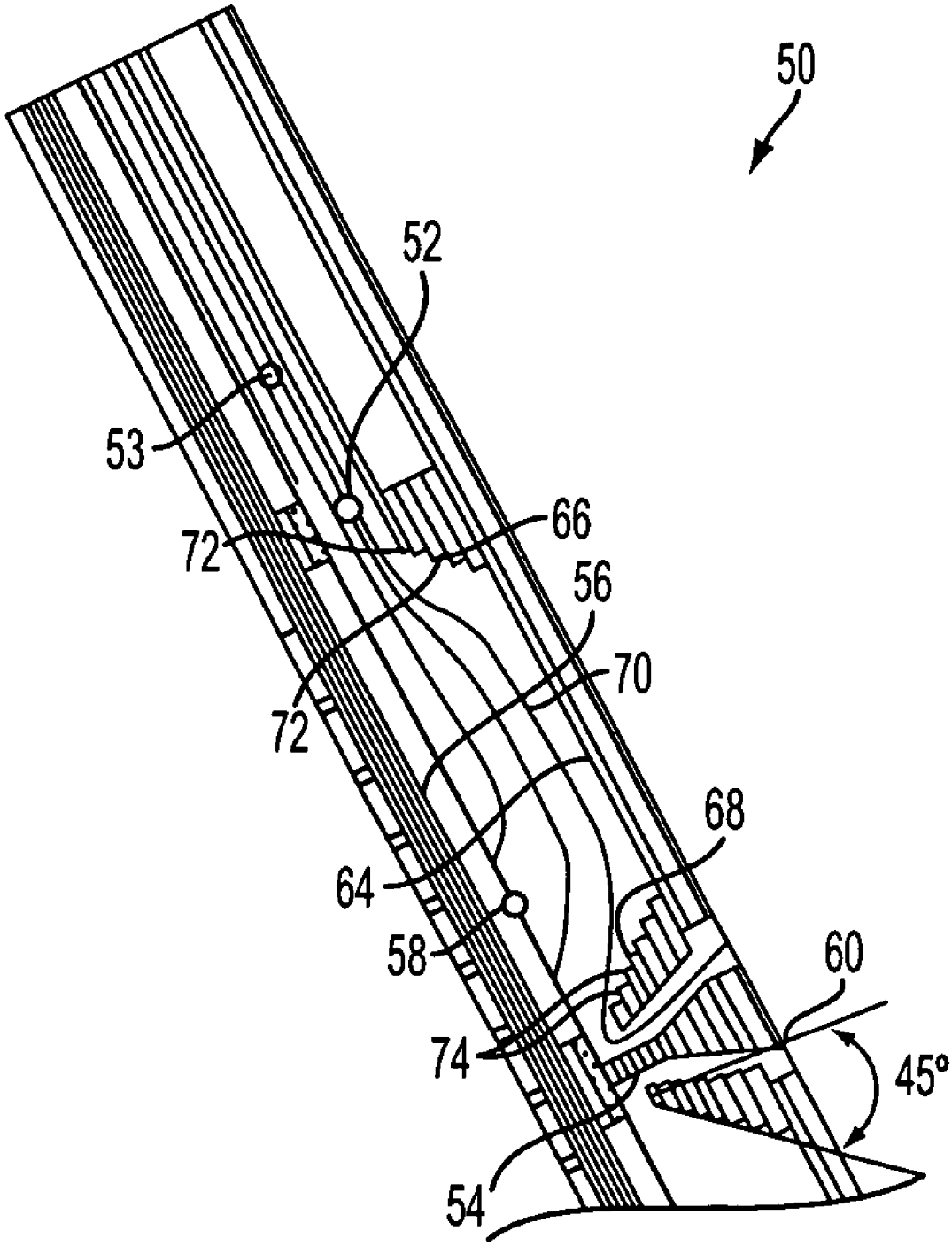
FIG. 3 is a cross-sectional view an inkjet finger manifold.

FIG. 3 is a cross-sectional view of a finger manifold 50 shown oriented so that a first end 52 is higher than an opposite end 54. The finger manifold 50 is a longitudinal chamber with the entrance 53 located at the first end 52 adjacent a first longitudinal side 56. A filter 58 along the first longitudinal side 56 is perforated with numerous small holes that act as exit ports. A purge vent 60 is located at the second end 54 on a second longitudinal side 64 opposite the first longitudinal side 56.

An entrance ramp 66 is located near the first end 52 and slopes away from the entrance 52 toward the second longitudinal side 64. A purge ramp 68 is located near the second end 54 and slopes from the second longitudinal side 64 toward the first longitudinal side 56 and the second end 54.

The entrance ramp 66 prevents bubbles from being buoyantly trapped in a corner. When flow 70 decreases or stops, a bubble remaining in the manifold 50 buoyantly rises toward the entrance ramp 66 and is directed to the entrance 53 where the bubble buoyantly rises out of the finger manifold.

The purge ramp 68 is oriented to prevent a split in the laminar flow 70 of the ink that traps a bubble next to the filter 58. The laminar flow 70 now directs a bubble entering the manifold 50 toward the purge vent 60 and out of the manifold 50.

The manifold 50 is typically part of a jet stack that is made up of a plurality of stacked plates. Each of the plates has etched cavities. When the plates are stacked, the etched cavities align to form passageways and the ink manifold 50.

The entrance ramp 66 may be formed by longitudinally offsetting the edges 72 of the cavities in the plates that form the manifold 50. The size of the cavity in each plate is increased, or decreased, to form the stair step offset edges 72. The purge ramp 68 may similarly be formed by longitudinally offsetting opposite edges 74 of the cavities in the plates that form the manifold 50.

When offset edges 72 and 74 are used to form the entrance and purge ramps 66 and 68, respectively, the stair-step nature of the edges redirects bubbles at least larger in diameter than the thickness of each plate. The corners of the stair-step offset edges 72 and 74 may still trap bubbles of equal size or less than the thickness of the plates.

Smaller bubbles dissolve quicker so it is desirable to reduce the size of bubble that may be trapped in the manifold 50. One way to decrease the potential bubble size is to reduce the thickness of the plates that form the portion of the jet stack that contains the finger manifolds 50. In that case, the finger manifold 50 is formed from the aligned cavities of a plurality of plates that are about 3 mils (0.076 mm) thick. This means the offset edges 72 and 74 redirect bubbles at least larger than 3 mils in diameter.

Decreasing plate thickness, however, quickly increases the cost of a jet stack because the cost of a plate remains the same no matter the thickness of the plate. Thus, decreasing plate thickness means increasing the number of plates in the jet stack and, thus, increasing the cost of the jet stack.

Figure 4:
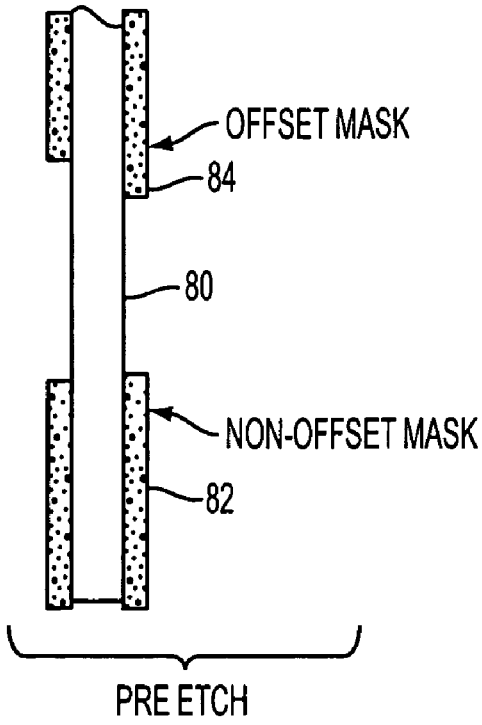
FIG. 4 is a pre-etch cross-sectional view of a jet stack plate showing a non-offset mask and an offset mask.
Figure 5:
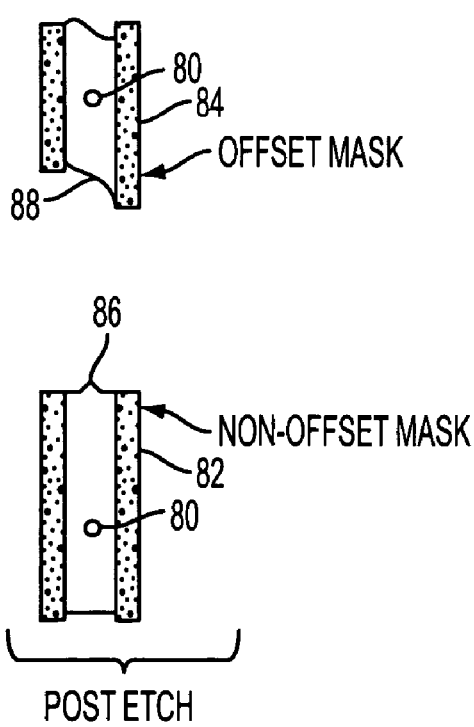
FIG. 5 is a post-etch cross-sectional view of the jet stack plate in FIG. 4.

Another way of increasing the effectiveness of the ramps is shown in FIGS. 4 and 5. The cavities in the plates may be formed using an offset mask etching that creates a sloped edge on the plate. FIG. 4 is a pre-etch cross-section of plate 80 showing a non-offset mask 82 on the lower portion and an offset mask 84 on the upper portion.

The plate 80 is chemically etched to form a cavity. FIG. 5 is a post-etch cross-section of the plate 80. The non-offset mask 82 produces a mostly 90° edge 86. The offset mask 84, however, produces a sloped edge 88.

If an offset mask 84 is used to create the offset edges 72 and 74 of FIG. 3, the entrance and purge ramps 66 and 68 have smoother slopes that allow for the redirection of much smaller bubbles out of the manifold 50.

Referring to FIGS. 3-5, an inkjet printhead may be manufactured by etching cavities defining ink channels, apertures and manifolds in a plurality of plates. The plurality of plates are stacked to form the printhead body thereby forming finger manifold 50 by aligning the etched cavities. The etched cavities are etched such that edges 72, 74 are offset on successive plates forming ramps 68, 66 within the finger manifold 50.

Etching edges 72, 74 may include etching them with an offset mask 84 to form sloped edges 88, thereby smoothing out the slope of the ramps 66, 68.

While the above-described finger manifold 50 is described within the context of using the manifold within a solid ink printer that feeds ink imagewise onto an intermediate printing drum, it is contemplated that the manifold 50 may also be used in other types of ink printers including water-based ink printers and printers with thermally activated printheads. The manifold 50 is advantageous for any ink distribution system that may utilize similar finger manifolds to distribute ink that may experience problems with bubbles being retained within the manifold.

It will be appreciated that various of the above-disclosed and other features and functions, or alternatives thereof, may be desirably combined into many other different systems or applications. Various presently unforeseen or unanticipated alternatives, modifications, variations, or improvements therein may be subsequently made by those skilled in the art which are also intended to be encompassed by the following claims.

What is claimed is:

1. An ink finger manifold in an inkjet printhead, comprising:

a longitudinal chamber having an entrance, a first longitudinal side, a purge vent, and a second longitudinal side, the entrance arranged at a first end adjacent the first longitudinal side and the purge vent arranged at a second end on the second longitudinal side opposite the first longitudinal side;

a filter arranged along the first longitudinal side, the filter having at least one ink exit port;

a first ramp formed from the first end higher than the second end; and an entrance ramp located near the first end, sloping away from the entrance and the first longitudinal side towards the second longitudinal side.

2. The ink finger manifold of claim 1, in which the longitudinal chamber comprises a stack of a plurality of plates having aligned cavities having longitudinally offset edges to form the first ramp.

3. The ink finger manifold of claim 2, in which each of the plurality of plates is about 3 mils thick.

4. The ink finger manifold of claim 2, in which the longitudinally offset edges are sloped edges.

5. The ink finger manifold of claim 1, the second longitudinal side further including a purge ramp near the second end sloping from the second longitudinal side toward the first longitudinal side and second end to alter a flow to the purge vent.

6. The ink finger manifold of claim 5, in which the longitudinal chamber comprises a stack of a plurality of plates having aligned cavities having longitudinally offset edges to form the entrance and purge ramps.

7. The inkjet finger manifold of claim 6, in which each of the plurality of plates is about 3 mils thick.

8. The inkjet finger manifold of claim 6, in which the longitudinally offset edges are sloped edges.

9. An ink finger manifold, comprising:

a longitudinal chamber having an entrance, a first longitudinal side, a purge vent, and a second longitudinal side, the entrance arranged at a first end adjacent the first longitudinal side; and the purge vent arranged at a second end on the second longitudinal side opposite the first longitudinal side;

a filter arranged along the first longitudinal side, the filter having at least one ink exit port;

a first ramp formed from the first end being higher than the second end; and a purge ramp located near the second end, sloping from the second longitudinal side towards the first longitudinal side and sloping towards the second end.

10. The ink finger manifold of claim 9, in which the longitudinal chamber comprises a stack of a plurality of plates having aligned cavities having longitudinally offset edges to form the ramp.

11. The ink finger manifold of claim 10, in which each of the plurality of plates is about 3 mils thick.

12. The ink finger manifold of claim 10, in which the longitudinally offset edges are sloped edges.

13. The ink finger manifold of claim 9, the first longitudinal side including an entrance ramp located near the first end, sloping away from the entrance and the first longitudinal side towards the second longitudinal side.

* * * * *